US006843731B1

(12) United States Patent
Oprandi

(10) Patent No.: US 6,843,731 B1
(45) Date of Patent: Jan. 18, 2005

(54) GOLF CLUB SWINGING GUIDE

(76) Inventor: Arthur V. Oprandi, 385 N. Point Rd. #1001, Osprey, FL (US) 34229

( * ) Notice: Subject to any disclaimer, the term of this patent is extended or adjusted under 35 U.S.C. 154(b) by 0 days.

(21) Appl. No.: 10/852,895

(22) Filed: May 25, 2004

(51) Int. Cl.[7] ..... A63B 69/36
(52) U.S. Cl. ..... 473/238; 473/226; 473/228
(58) Field of Search ..... 473/218, 219, 473/226, 228, 229, 231, 238, 457, 268, 269

(56) References Cited

U.S. PATENT DOCUMENTS

| | | | | | |
|---|---|---|---|---|---|
| 1,712,609 | A | | 5/1929 | Gibson | |
| 2,652,251 | A | | 9/1953 | Molinar | |
| 3,033,574 | A | | 5/1962 | Partridge | |
| 3,198,525 | A | | 8/1965 | Smith | |
| 3,262,705 | A | | 7/1966 | Nunziato | |
| 3,298,693 | A | | 1/1967 | Eisenberg | |
| 3,719,363 | A | | 3/1973 | Harrison | |
| 3,758,117 | A | * | 9/1973 | Harrison | 473/231 |
| 4,576,378 | A | | 3/1986 | Backus | |
| 4,789,158 | A | | 12/1988 | Chiesa | |
| 4,949,971 | A | | 8/1990 | Thornton | |
| 5,071,129 | A | | 12/1991 | Wilson | |
| 5,143,376 | A | | 9/1992 | Johnson | |
| D347,457 | S | | 5/1994 | Armstrong, III | |
| 5,310,188 | A | * | 5/1994 | Hernberg | 473/206 |
| 5,351,962 | A | | 10/1994 | Lin | |
| 5,605,509 | A | | 2/1997 | Gray | |
| 5,716,286 | A | * | 2/1998 | Swan | 473/175 |
| 5,762,564 | A | | 6/1998 | Schang | |
| 6,722,999 | B1 | * | 4/2004 | Yi | 473/238 |

OTHER PUBLICATIONS

Freddy Connect Products, Inc.—Dual Trace Swing Trainer User's Guide.
How it works . . . website www.freddyconnect.com/howit-works.htm pp. 1 and 2.

* cited by examiner

*Primary Examiner*—Gregory Vidovich
*Assistant Examiner*—Nini F. Legesse
(74) *Attorney, Agent, or Firm*—Charles J. Prescott

(57) ABSTRACT

A golf club swinging guide releasably attachable to a lower end of a golf club shaft. The guide includes a stationary member having an alignment surface which, when adjustably aligned parallel to the striking face of the golf club head, automatically orients the visual intended line of flight perpendicular to the club face. A movable member is connected for free rotation to the stationary member about an upright axis of rotation which passes centrally through an enlarged clearance aperture through the stationary and movable members to facilitate installation over the grip area of the shaft. A wind vane extends laterally from one end of the movable member whereby the movable member is responsive to movement of air to visually align itself in a direction that the golf club is swung. Visual misalignment between the intended line of flight and the actual direction of golf club swing is viewable during a golf swing. Temporary securement of the alignment at the instant of golf ball impact is also provided.

6 Claims, 11 Drawing Sheets

GOLF CLUB SWINGING GUIDE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to practice and corrective devices associated with the golf swing and the game of golf and more particularly to a golf club swinging guide which provides immediate viewable indicia reflective of any misalignment between the golf swing itself and the direction the striking face of the golf club head faces at the moment of golf ball impact.

2. Description of Related Art

The world of golf has attracted a vast mountain of players, competitors and golf club equipment, not to mention the vast investment in golf courses themselves. However, the game of golf is premised upon a golf swing which is at best unnatural. Developing a correct swing for consistent power and accuracy is the ultimate challenge of every golfer.

One aspect of this golf swing perfection challenge is to cause the golf club striking face to strike the golf ball in a line of movement and with a club face striking face orientation which will propel the golf ball in a desired direction and with the desired amount of hook, slice or straight flight characteristics. One patent disclosure by Johnson in U.S. Pat. No. 5,143,376 has provided such a golf club swinging guide. This invention by Johnson provides a swinging guide somewhat permanently clampable onto the lower end of the golf shaft of the golf club and provides a vane pivotally connected to that mount. The vane is freely pivotal and responsive to movement of air so that the vane visibly aligns itself in the direction of the golf club swing.

A broad array of additional U.S patented devices also provide some means for visually aligning the striking face of the golf club head with the golf ball on a more static pre-swing basis as follows:

U.S. Pat. No. 4,789,150 Chiesa

U.S. Pat. No. 1,712,609 Gibson

U.S. Pat. No. 2,652,251 Molinar

U.S. Pat. No. 3,198,525 Smith

U.S. Pat. No. 3,262,705 Nunziato

U.S. Pat. No. 3,298,693 Eisenberg

U.S. Pat. No. 3,719,363 Harrison

U.S. Pat. No. 4,576,378 Backus

U.S. Pat. No. 4,949,971 Thornton

U.S. Pat. No. 5,071,129 Wilson

U.S. Pat. No. 5,351,962 Lin

U.S. Pat. No. 5,605,509 Gray

U.S. Pat. No. 5,762,564 Schang

U.S. Patent No. D347,457 Armstrong

The present invention provides a substantial improvement over the Johnson '376 swinging guide in that many of the forces associated with the high velocity and arcuate movement of a golf club head are somewhat neutralized in the present invention over the Johnson device so that a more accurate indication of misalignment at the moment of golf ball impact is viewable. Further, a means for temporarily locking the misalignment relationship at the moment of golf ball impact is also provided.

BRIEF SUMMARY OF THE INVENTION

This invention is directed to a golf club swinging guide releasably attachable to a lower end of a golf club shaft. The guide includes a stationary member defining a longitudinal intended line of flight and an alignment surface which, when adjustably aligned parallel to the striking face of the golf club head, automatically orients the intended line of flight perpendicular to the club face. A movable member is connected for free rotation to the stationary member about an upright axis of rotation which passes centrally through an enlarged clearance aperture through and common with the stationary and movable members to facilitate installation over the grip area of the shaft. A wind vane extends laterally from one end of the movable member whereby the movable member is responsive to movement of air to visually align itself in a direction that the golf club is swung. Visual misalignment between the intended line of flight and the direction of golf club swing is thus visually viewable during a golf swing. Temporary securement of this misalignment (or proper alignment) fixed at the instant of golf ball impact for past-swing viewing is also provided.

It is an object of this invention to provide a golf club swinging guide offering immediate viewable indicia to the golfer related to the relative orientation of the golf club striking face to the actual direction of swing at the moment of golf ball impact.

Still another object of this invention is to provide a highly visible indication of misalignment between the direction of the golf ball swing and the orientation of the golf ball striking face of a golf club head at the moment of golf ball impact.

Yet another object of his invention is to provide a means for temporarily locking the viewable indicia of misalignment (or proper alignment) between the golf club swing direction and the orientation of the striking face of the golf club head which may be viewed then released after the swing.

Still another object of this invention is to provide a golf club swinging guide releasably attachable to the lower end of the shaft of the golf club which is substantially less influenced by centrifugal and inertial change forces of the club head and lower shaft to provide a more accurate visible indication of misalignment between the golf club swing direction and the orientation of the striking face of a golf club head.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
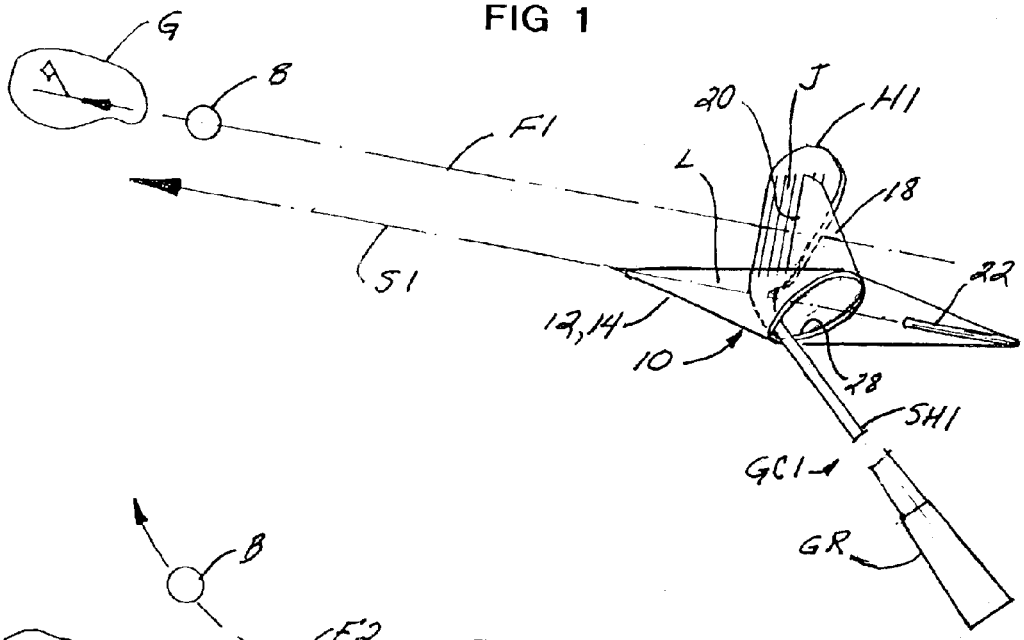
FIG. 1 is a simplified schematic view of one embodiment of the device attached to the lower end of a golf club in the form of an iron.

Referring now to the drawings, and firstly to FIGS. 1 to 4, one embodiment of the invention is there shown generally at numeral 10. This embodiment 10 includes an elongated stationary member 12 having a generally elongated diamond shape in plan view and a similarly shaped moveable member 14. These members 12 and 14 are typically fabricated of molded or formed light weight flat plastic material having sufficient stiffness and resiliency for the task at hand yet of sufficiently light weight so as to be relatively unencumbered by the centrifugal and inertial forces associated with being attached near the head end of a golf club during swinging thereof.

The stationary and movable members 12 and 14 are connected together for free relative rotation about axis 30, the center of a circular clearance aperture 28 which, as seen in FIG. 1, is of sufficient diametrical width to slide over the enlarged upper end of a grip GR of a shaft SH1 of a golf club GC1. Relative free rotation in the direction of the arrow in FIG. 3 between the stationary end movable members 14 and 12, respectively, is effected by an inexpensive fabricated bearing arrangement best seen in FIG. 4. Note in this embodiment that the axis of rotation 30 is generally parallel to and displaced from the longitudinal axis of the golf club shaft SH1 or SH2.

Figure 3:
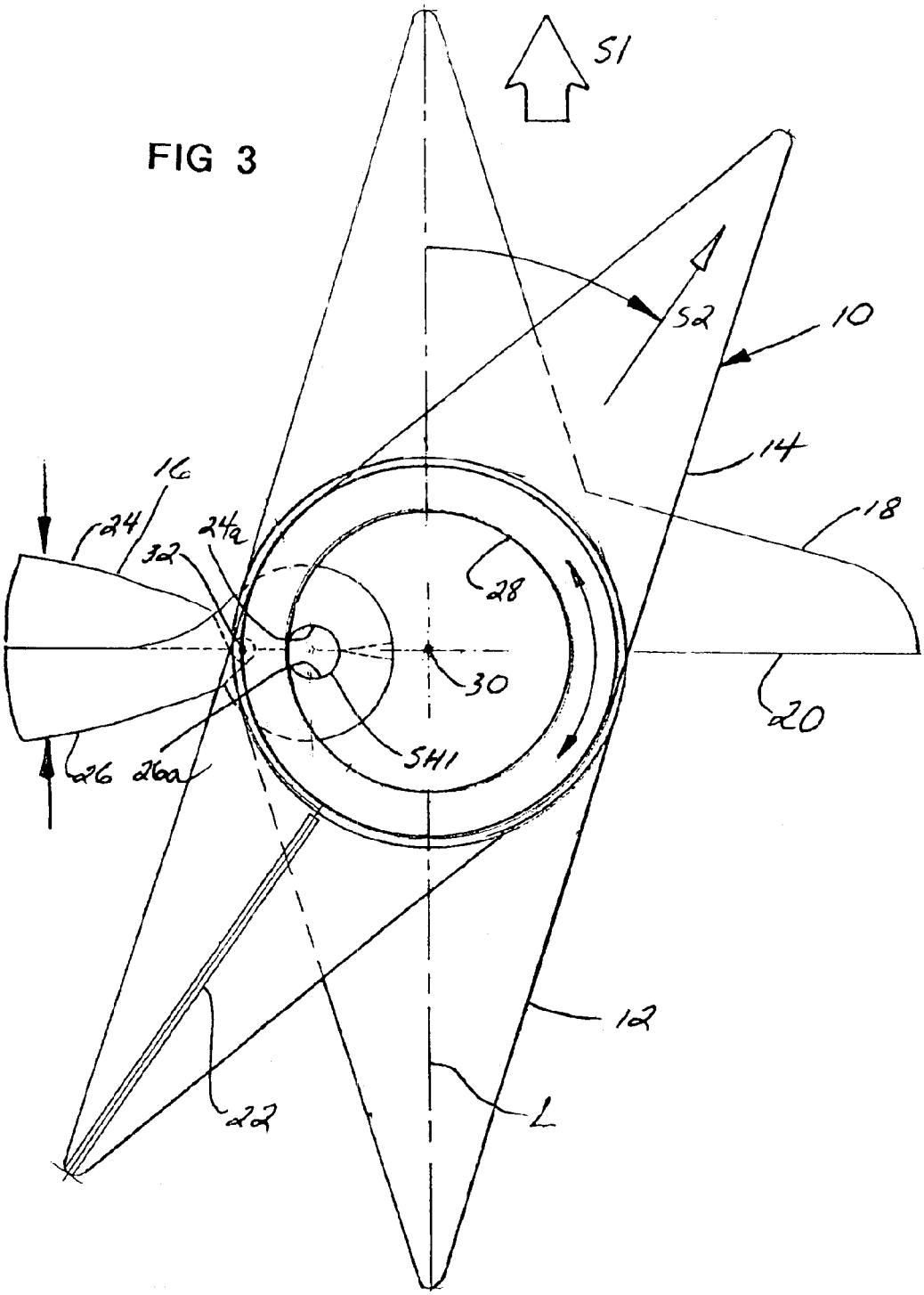
FIG. 3 is a top plan view of the embodiment of FIG. 1.
Figure 4:
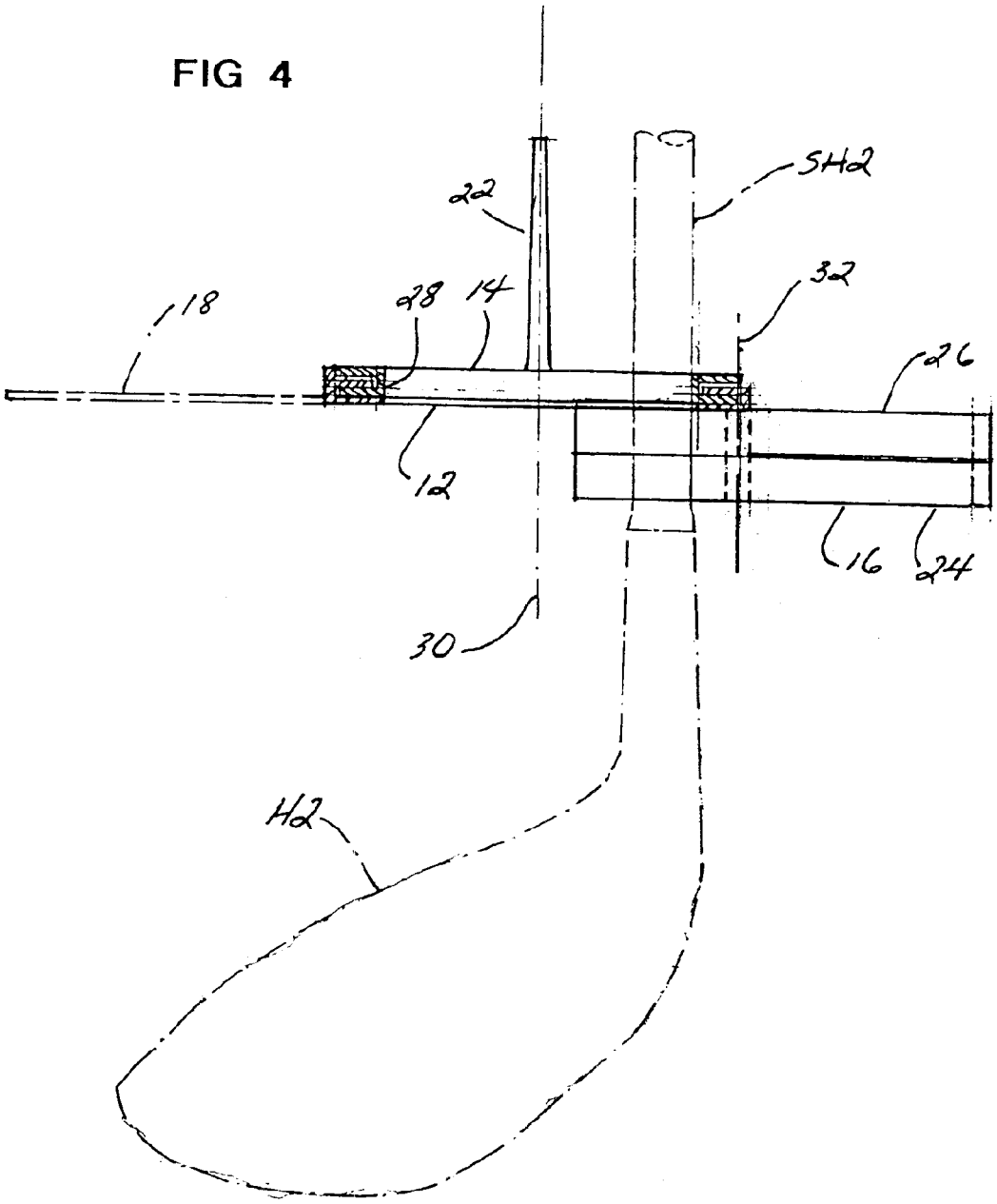
FIG. 4 is a side elevation view of FIG. 3 is partial section and showing a golf club shaft and head in phantom.

A releasable mount 16 is rigidly connected to, and centrally positioned on, the stationary member 12 and is formed of two opposing spring loaded arms 24 and 26 which, when squeezed together, causes the clamping jaws 24*a* and 26*a* to open about pivotal axis 32, and when released, provide for a friction clamping force to be exerted against the lower end of the golf club shaft SH1 shown in FIG. 3. This releasable connection of the mount 16 to the lower end of the shaft SH1 is effected after the device 10 has been slid downwardly through its aperture 28 over the grip GR of the golf club shaft SH1.

The stationary member 12 further includes an alignment surface or edge 20 formed as a part of forward extension 18. This alignment surface or edge 20 is fixed in perpendicular orientation with respect to a longitudinal line L of the stationary member 12. Line L may be imaginary as defined by the tips of the elongated diamond shape of the stationary member 12 or may be applied in some viewable indicia such as in line or dot form for easier observation during each golf swing.

An upwardly extending wind valve 22 is connected or formed with one end of the movable member 14. This vane 22 causes the movable member 14 to become aligned with the direction of swing.

Again, in FIG. 1, the preferred orientation and alignment of the striking face J is established after the device 10 is attached to the lower end of shaft SH1 as shown. After the releasable mount 16 has been clampingly engaged to secure the device in its position shown, slight forced adjustable rotating movement of the stationary member L may be effected so that the alignment edge 20 is exactly parallel to the plane of the striking surface J.

At this point, the golfer is ready to visually align the line L with a projected sight line S1 which is substantially parallel to and only slightly displaced by an inch or two from the intended line of flight F1 of the golf ball B after it is struck. In other words, the golfer simply aligns the line L of the stationary member 12 to be aimed at the green G or some other landmark down a fairway before commencing the back swing of the golf club with the device 10 properly attached thereto and aligned.

Figure 2:
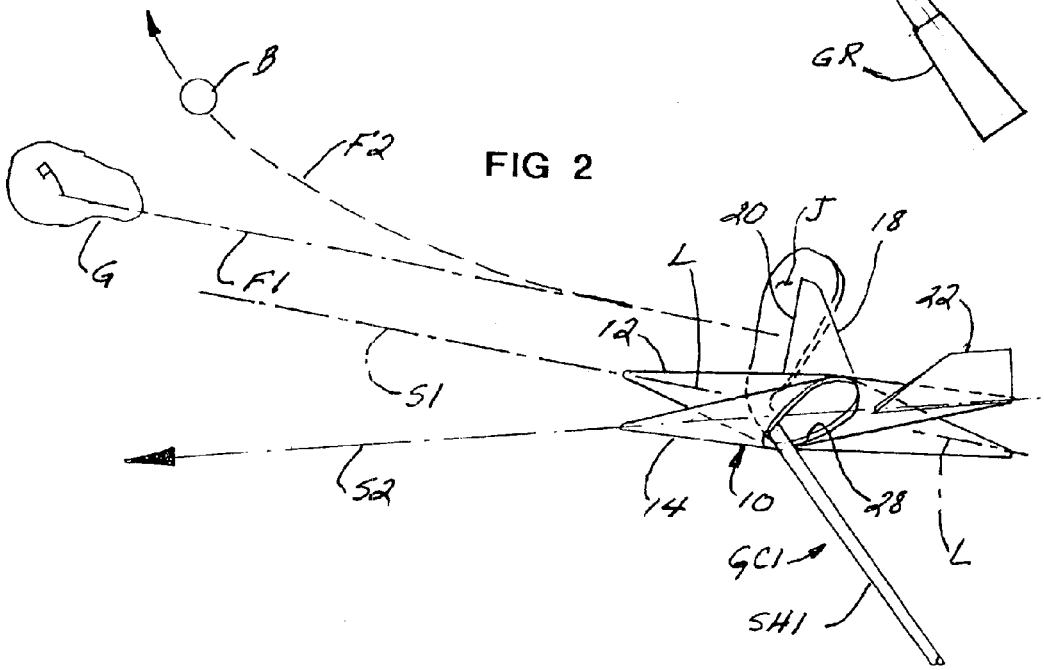
FIG. 2 is a view similar to FIG. 1 depicting a condition of swing misalignment.

During the down swing, as shown in FIG. 2, a condition of misalignment is there depicted. In this circumstance, the striking face J is properly aligned perpendicular to the intended flight line F1. However, the arc of the swing is depicted as being in the direction of S2 rather than S1, the desired flight line, and is so indicated because the weathervane 22 attached and upwardly extending from the rearward portion of the moveable member 14, has been aligned with the direction of air movement there over which has thus caused the free relative rotation of the movable member 14 into the position shown, i.e. the actual arc of the swing at the moment of golf ball impact. As a result, the golfer could expect the golf ball B to slice to the right along flight line F2.

Note that virtually all other combinations of alignment and misalignment either intentionally or unintentionally causing a golf ball flight to be other than directed straight at the green or fairway feature at which the golfer has intended to drive the golf ball.

Referring now to FIGS. 5 to 11, a second embodiment of the invention is there shown generally at numeral 40. In this embodiment, the elongated diamond feature of each of the stationary and movable members 42 and 44, respectively, has been emphasized. Again, these members 42 and 44 are constructed preferably of thin lightweight plastic material whether fabricated or each separately molded as a unit. The mounting arrangement in this embodiment 40 includes two pivotal clamping arms 46 and 48, each having a cylindrical semi-circular shaft engaging saddle 54 and 56, respectively, attached thereto in mating fashion surrounding an axis of rotation 58.

Figure 9:
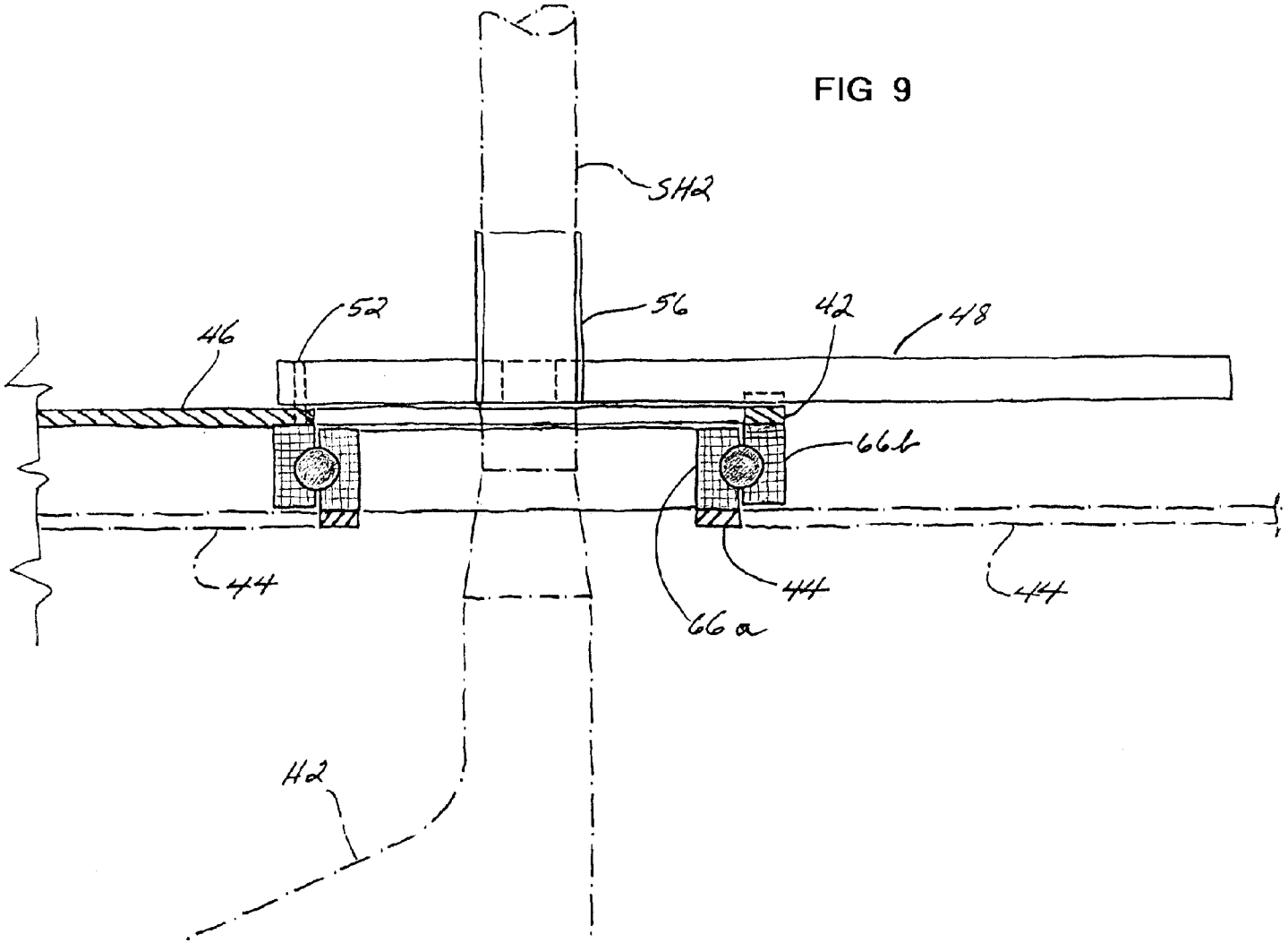
FIG. 9 is an enlarged side elevation section view of FIG. 5 showing a golf club head and lower shaft in phantom.

The free rotation between the stationary and movable members 42 and 44 is accomplished by a more sophisticated lightweight bearing arrangement as best seen in FIG. 9. The preferred bearing having bearing halves 66*a* and 66*b* is supplied by Dynaroll Corporation or preferably from a selection of suitably sized plastic ball bearings by KMS Bearings, Inc. Again, the inside diameter of the inner bearing portion 66*a* must be of sufficient size for clearance around the enlarged upper distal end of the grip G of the shaft SH1 or SH2.

A rotational alignment member 60 having parallel alignment edges 62 and 64 extends forwardly of and is preferably formed as a unit with the stationary member 42. The movable member 44, again freely rotatable with respect to the stationary member 44, includes a downwardly extending vane 68 which is positioned along the outer rearward half of the movable member 44 and is preferably formed as a unit therewith.

Figure 5:
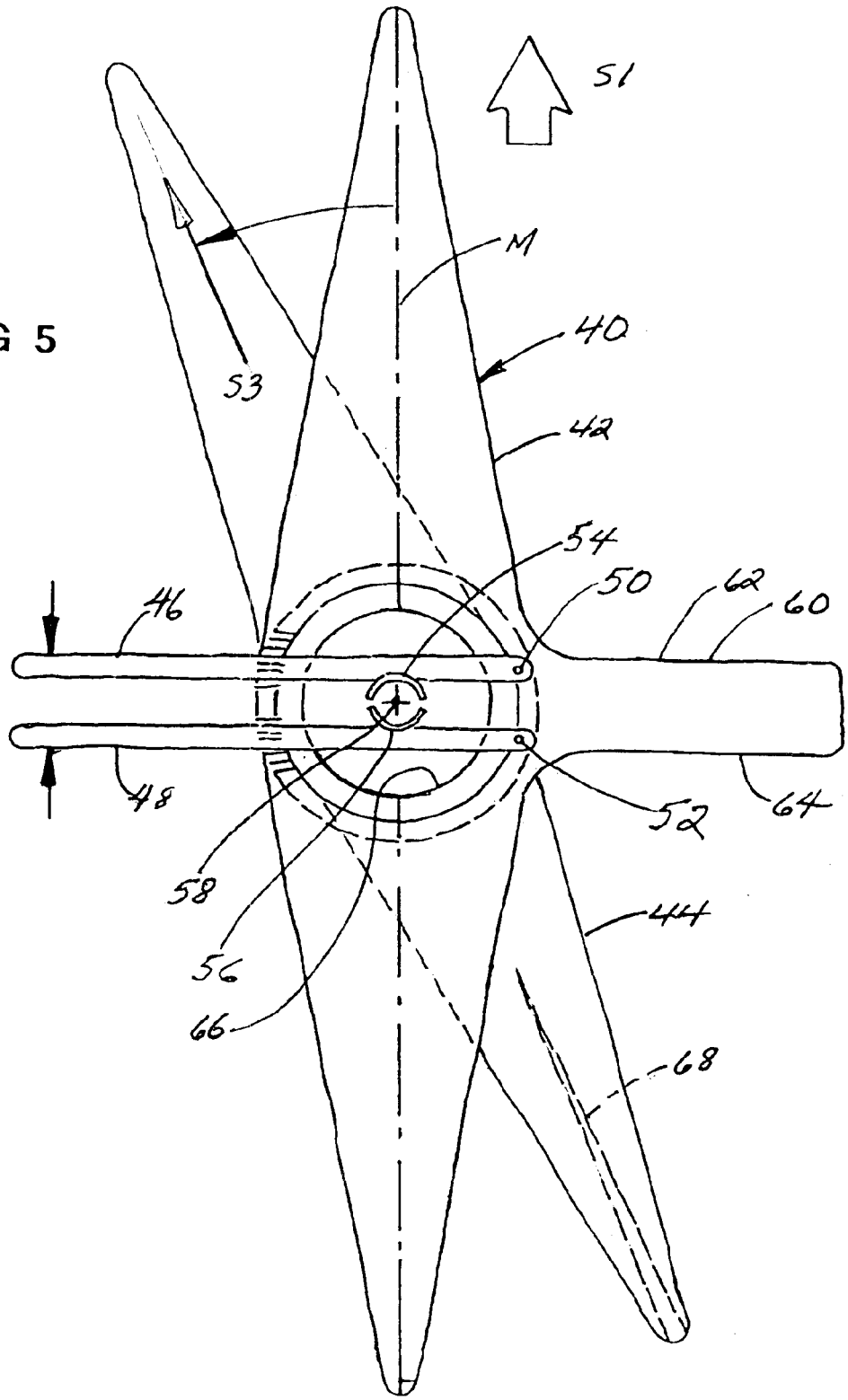
FIG. 5 is a top plan view of another embodiment of the invention.
Figure 6:
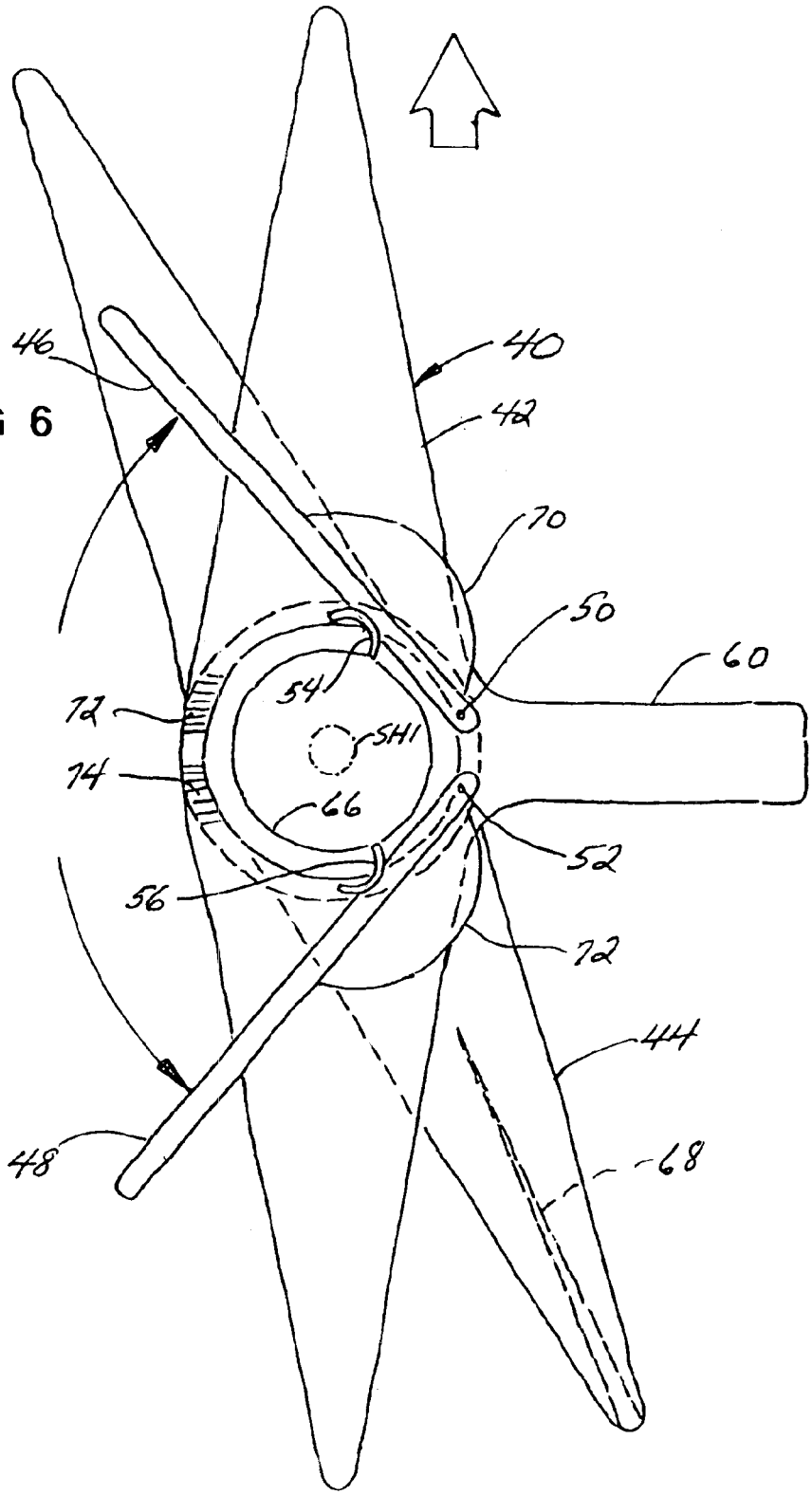
FIG. 6 is a view similar to FIG. 5 showing the releasable shaft mount in the open position.
Figure 7:
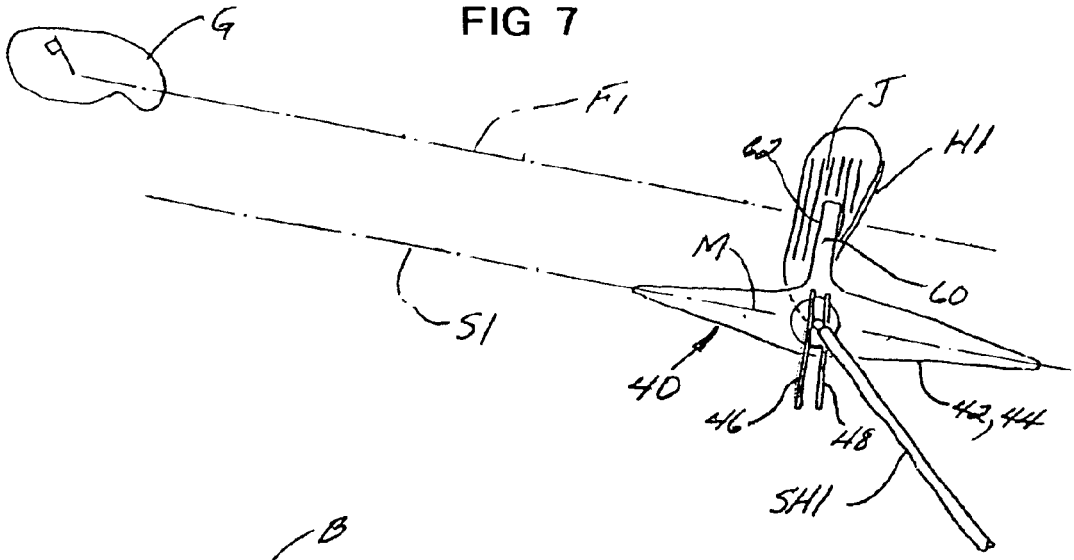
FIG. 7 is a view similar to FIG. 1 showing the embodiment of the invention of FIG. 5.
Figure 8:
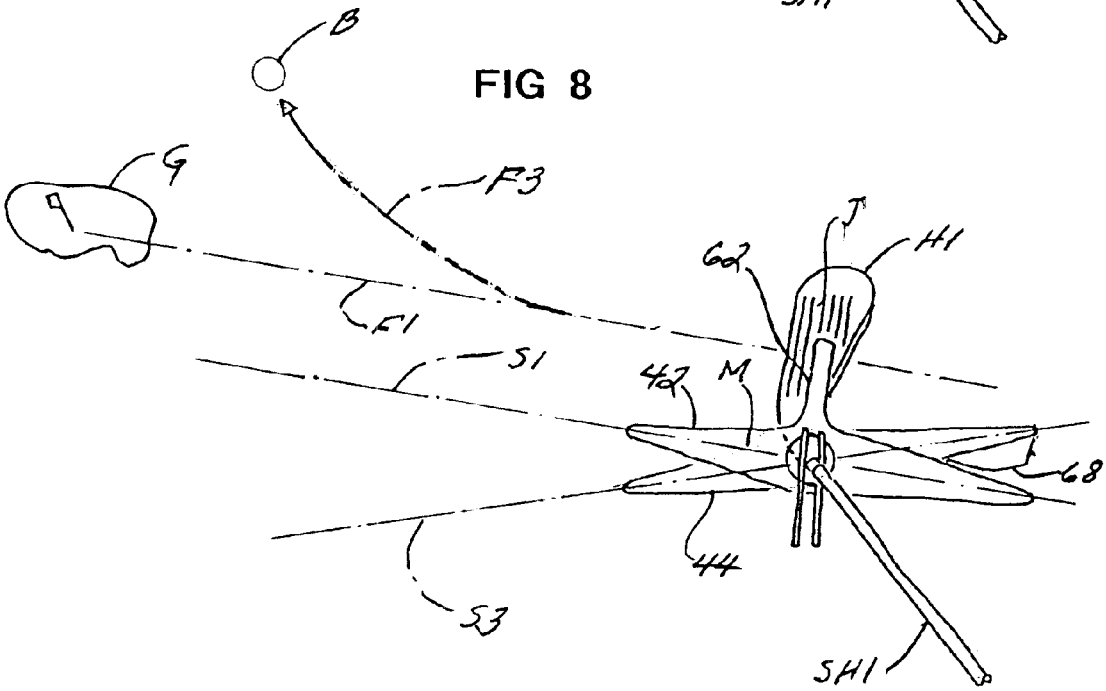
FIG. 8 is a view similar to FIG. 2 again showing the embodiment of the invention of FIG. 5.
Figure 10:
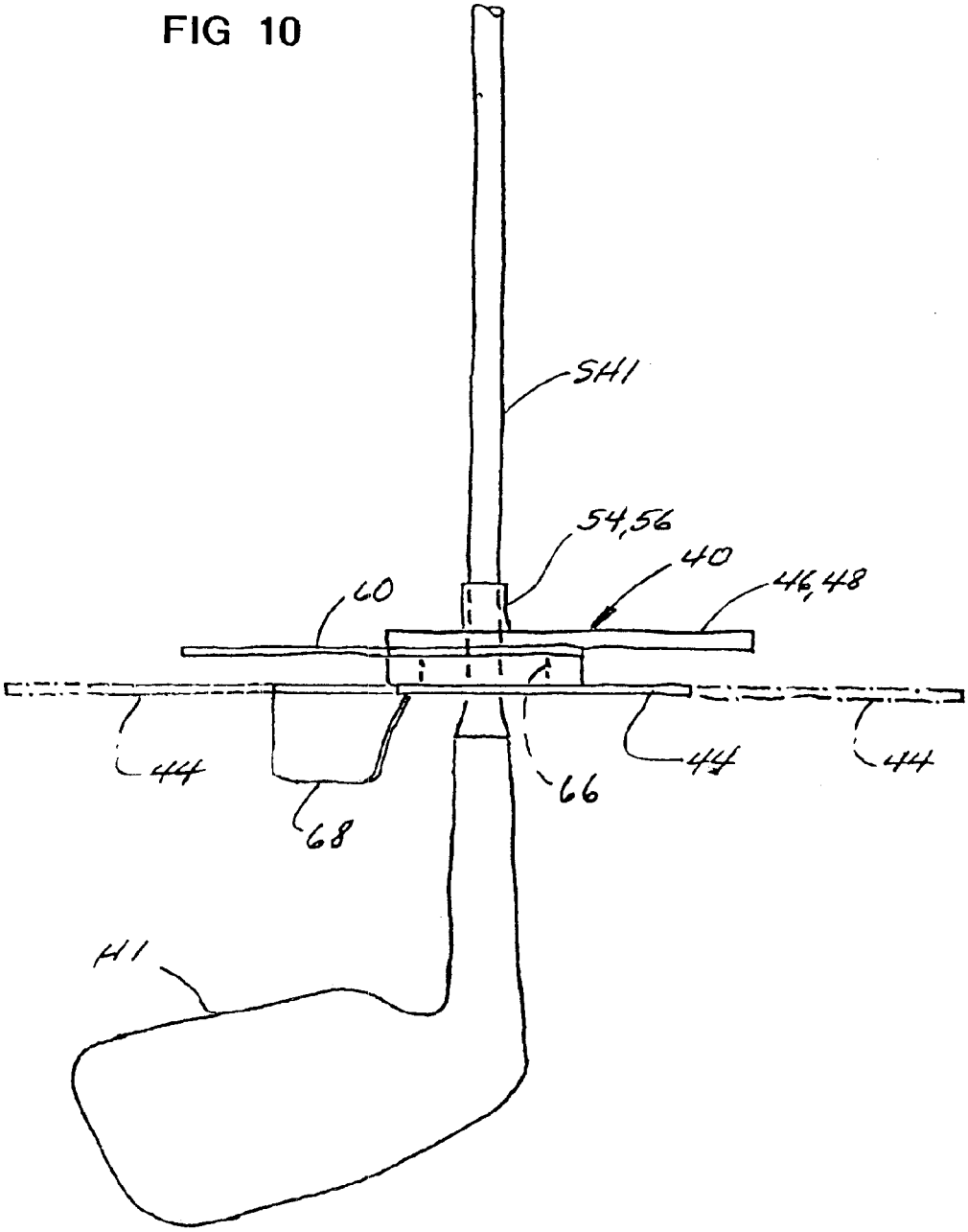
FIG. 10 is a side elevation view of FIG. 5.
Figure 11:
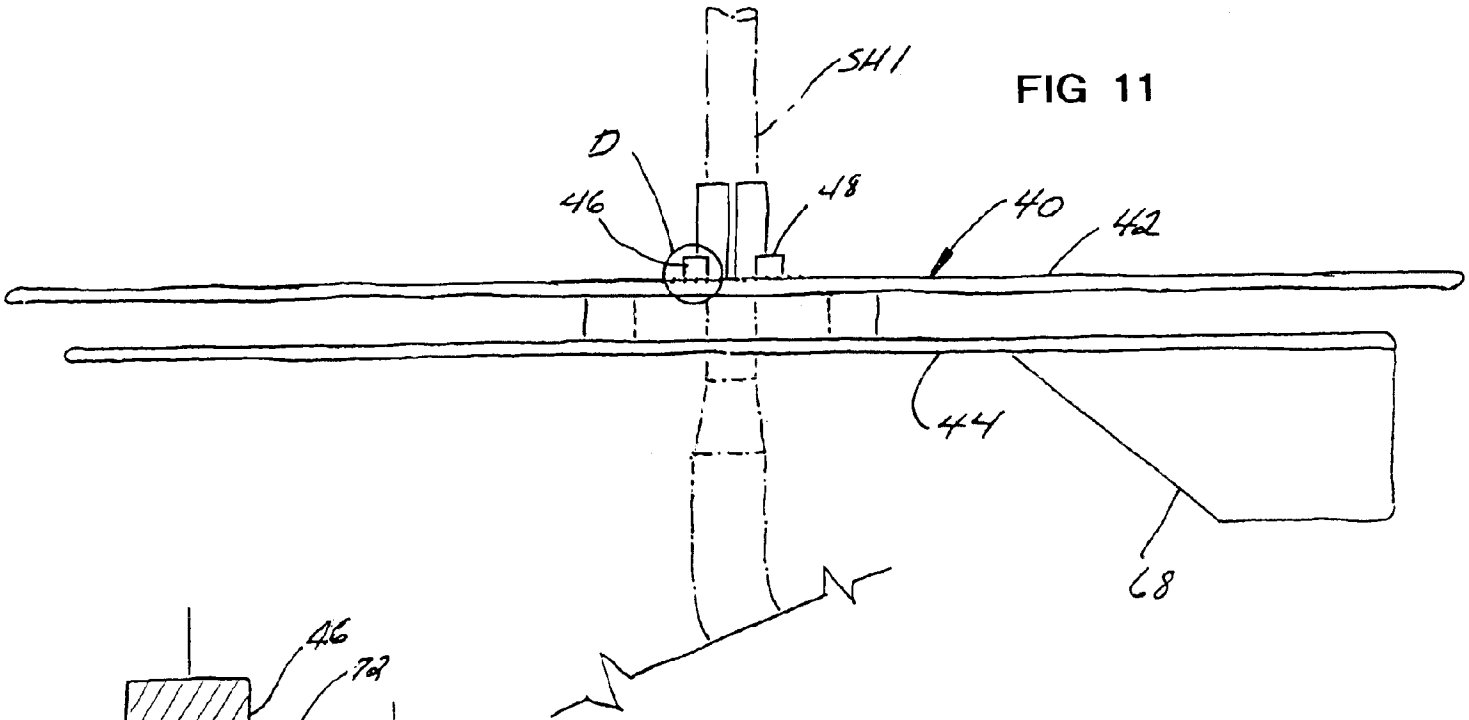
FIG. 11 is a rear elevation view of FIG. 10.
Figure 12:
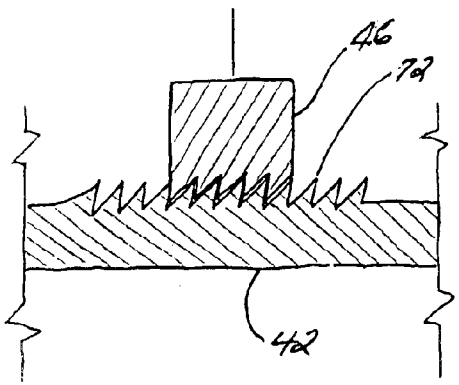
FIG. 12 is an enlargement of area D of FIG. 11.

To install this embodiment 40, the clamping arms 46 and 48 are opened pivotally as shown in FIG. 6 about the pivotal connections 50 and 52, respectively, the entire device 40 is slid over the upper end of the grip G through the clearance aperture 66, moved downwardly in the position shown in FIGS. 9 and 10 with respect to the club head H1 or H2 and thereafter, the clamping arms 46 and 48 are moved together in the position shown in FIG. 5. The cylindrical gripping saddles 54 and 56 clampingly engage onto the lower portion of the shaft SH1 or SH2 as best seen in FIGS. 9 to 11 providing for substantial frictional immobilization of the device 40 except for the ability to slightly forcefully adjust the rotational alignment of the alignment surfaces 62 or 64 as seen in FIGS. 7 and 8. When either of the alignment surfaces 62 or 64 is viewed by a player as being parallel with the striking face J, the locking arms 46 and 48 may be further tightened and held in the tightened position by a tooth ratchet arrangement including serrations 72 and 74 formed into the upwardly surface surrounding the outer bearing portion 66*b* which matably engage with downwardly extending saw tooth teeth of each of the clamping members 46 and 48 as seen in FIG. 12.

As seen in FIGS. 7 and 8, this embodiment 40 is used in the same fashion as previously described in FIGS. 1 and 2 wherein the stationary member 42 is rotationally aligned so that one of the parallel alignment edges 62 or 64 is viewed parallel to the striking face J so that the longitudinal sight line M of the stationary member 42 is substantially aimed along projected line S1 parallel to the intended flight line F1 toward a typical target such as a green G. In FIG. 8, although the alignment of the device 40 is proper with respect to alignment surface 62 and the striking face J, the direction of the swing S3 is indicated by the movable member 44 acting against wind resistance of vane 68 turning the movable member 44 to align with the swing arc S3 rather than the intended swing arc S1. This misalignment will cause the ball B to slice along an unintended flight line F3 because of this misalignment between the arc of the swing S3 and the intended arc S1.

Figure 13:
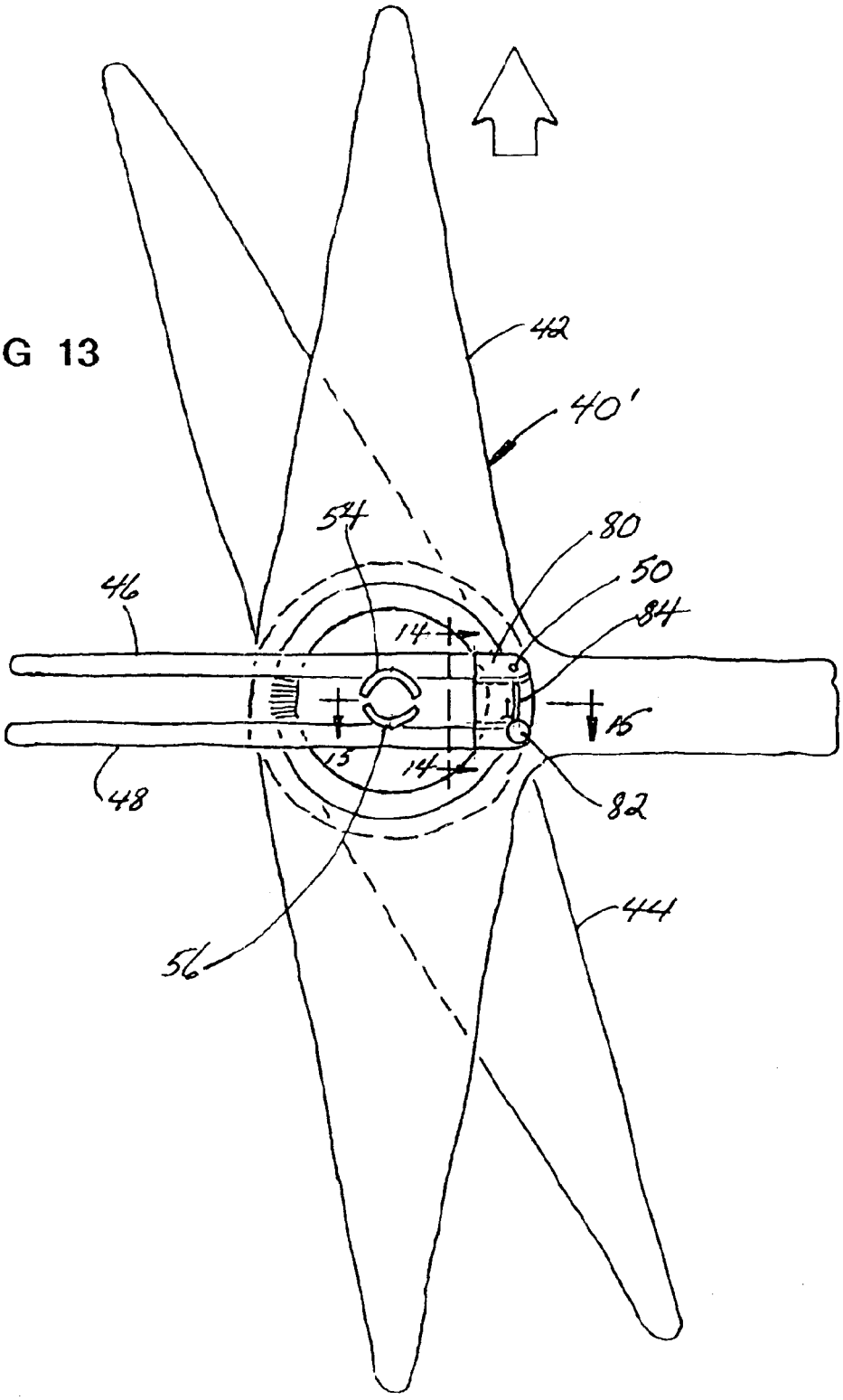
FIG. 13 is a top plan view of a third embodiment of the invention.
Figure 14:
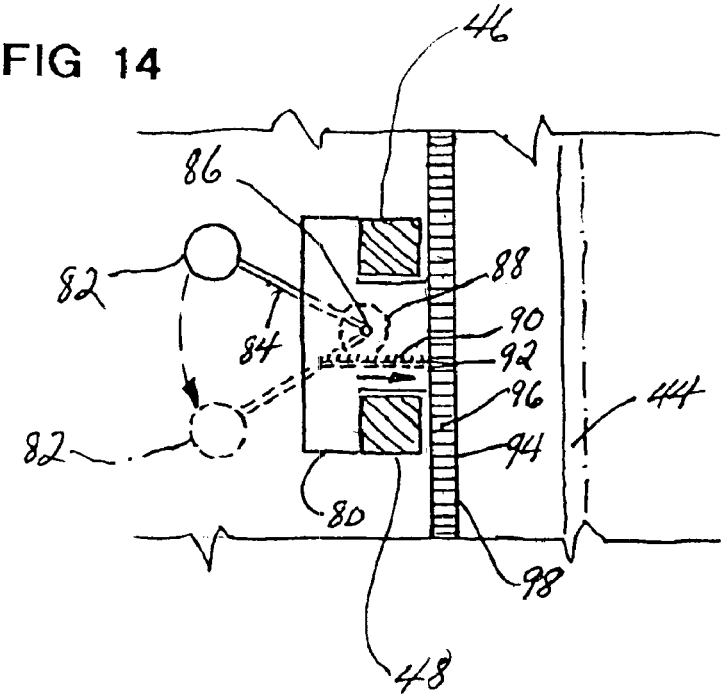
FIG. 14 is a section view in the direction of arrows 14—14 in FIG. 13.
Figure 15:
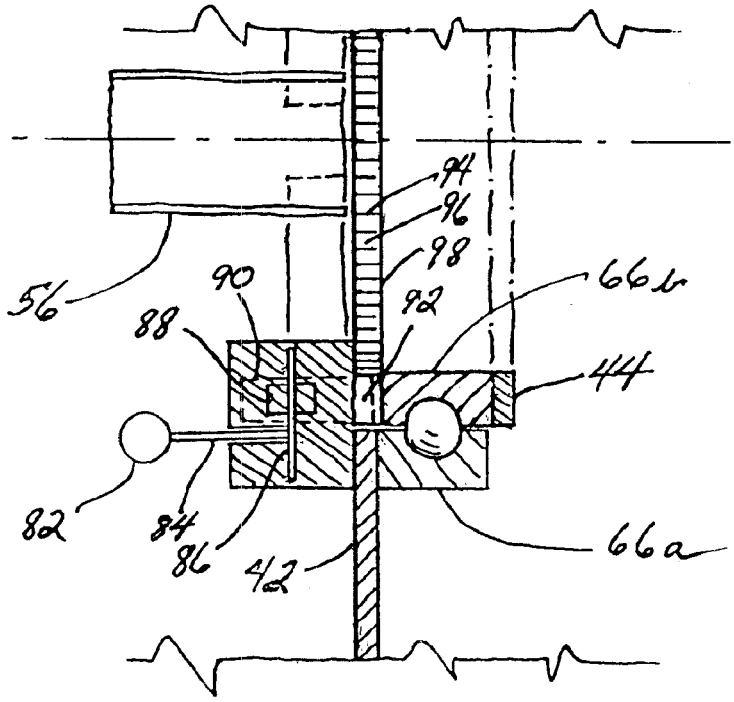
FIG. 15 is a section view in the direction of arrows 15—15 in FIG. 13.

Referring now to FIGS. 13 to 15, a third embodiment of the invention is there shown generally at numeral 40'. This embodiment 40' is substantially similar to the embodiment 40 described previously. However, the ability of the golfer to concentrate both upon a proper swing and to visually observe the alignment or misalignment between the movable and fixed members 44 and 42, respectively, may be a bit challenging for a novice or intermediate golfer. Therefore, this embodiment 40' provides a means for temporarily locking the misalignment (or alignment) relation between the fixed and movable members 42 and 44, respectively, at the moment of golf ball impact with the striking face of the golf club. This feature based upon a momentum change or sound produced at golf ball impact, will generally allow the golfer to concentrate on the swing and then view the temporarily held condition of alignment between the stationary and movable members 42 and 44 after the swing.

To accomplish this temporary locking arrangement in one simple although not limiting embodiment of this concept, an inertial ball 82 is held on a lightweight shaft 74 which is pivotally connected at 86 to a mounting block 80 attached to the upper surface of the stationary member 42 immediately along side of the alignment aperture 66*b*. The pivotal arm 84, when rotated in the direction of the arrow in FIG. 14, also rotates a small plastic gear 88 which, in turn, moves a small elongated rack 90 in the direction of the arrow in FIG. 14. One end 92 of the rack 90 has a tapered knife edge which, when moved in the position shown in phantom in FIG. 14 and in FIG. 15, engages between two adjacent fins 94 which define spaced slots 96.

As should now be clear, upon impact with the golf ball, the inertial member 82 instantly moves in the direction of the arrow in FIG. 14 into the orientation shown in phantom whereupon the tapered knife edge 92 engages within one of the slots 96 thus temporarily locking the rotational relationship between the movable and the stationary members 44 and 42, respectively. After the golf swing, the golfer may then examine the alignment relationship between the stationary and movable members 42 and 44 to analyze the swing and thereafter reset the device by moving the inertial member 82 into the position shown as solid line in FIG. 14 thus releasing the stationary and movable members 42 and 44 for free relative rotation therebetween ready for the next golf swing.

Again, the embodiment of the general temporary locking arrangement is intended for illustration and is not intended to be limiting in that other spring-loaded arrangements triggered by impact or sound capable of releasing upon golf ball impact to lock the stationary and movable members together momentarily for observation after the swing are intended to be within the scope of this invention and this aspect of the disclosure.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A golf club swinging guide for a golf club having a shaft with a grip and a head with a striking face, said guide comprising:

an elongated stationary member defining a longitudinal intended line of flight and including a mount which is attachable to the golf club shaft just above the head of the golf club, said stationary member further including an alignment surface which, when aligned parallel to the striking face, automatically orients the intended line of flight perpendicular to the club face;

an elongated movable member connected for free rotation to said stationary member about an axis of rotation which passes centrally through an enlarged clearance aperture through and common to said stationary and movable members, said clearance aperture sized to pass over an enlarged upper grip area of the shaft when said guide is installed onto and removed from the golf club;

a wind vane connected to and generally orthogonally extending from one end of said movable member whereby said movable member is responsive to movement of air to visually align itself in a direction that the golf club is swung;

any difference between the intended line of flight and the direction of golf club swing being visually viewable in the form of misalignment between said stationary and movable members during the golf swing.

2. A golf club swing guide as set forth in claim 1, wherein:

said stationary and movable members are releasably locked together in a particular alignment relation about the axis of rotation during a golf club swing at the moment of impact between the striking face and a golf ball whereby any misalignment between the stationary and movable members is preserved for view and analysis after the golf club has been swung.

3. A golf club swinging guide for a golf club having a shaft with a grip and a head with a striking face, said guide comprising:

a stationary member having an elongated diamond shape defining a longitudinal intended line of flight and including a mount which is releasably attachable to the golf club shaft just above the head of the golf club, said stationary member further including an alignment member defining a straight club head alignment edge surface which, when viewably aligned parallel to the striking face while holding the grip, automatically orients the intended line of flight perpendicular to the club face whereupon the intended line of flight may be visually projected by golf club rotation at, or in the direction of, a desired location;

an elongated movable member having an elongated diamond shape similar to that of said stationary member and connected for free rotation to, said stationary member about an axis of rotation which passes centrally through an enlarged clearance aperture through and common to said stationary and movable members, said clearance aperture sized to pass over an enlarged upper grip area of the shaft as said guide is installed onto the shaft, said axis of rotation being substantially coaxially aligned with the shaft;

a wind vane connected to and extending from a trailing portion of said movable member whereby said movable member is responsive to movement of air to visually align itself in a direction that the golf club is swung;

visual misalignment between the intended line of flight and the direction of golf club swing being visually perceivable in the form of misalignment between said stationary and movable members during a golf swing.

4. A golf club swing guide as set forth in claim 3, wherein:

said stationary and movable members are releasably locked together in a particular alignment relation about the axis of rotation during a golf club swing at the moment of impact between the striking face and a golf ball whereby any misalignment between the stationary and movable members is preserved for view and analysis after the golf club has been swung.

5. A golf club swinging guide for a golf club having a shaft with a grip and a head with a striking face, said guide comprising:

an elongated stationary member defining a longitudinal intended line of flight and including a mount which is attachable to the golf club shaft just above the head of the golf club, said stationary member further including an alignment surface which, when adjustably aligned parallel to the striking face by rotation of said mount on the shaft, automatically orients the intended line of flight perpendicular to the club face;

an elongated movable member connected for free rotation to, and generally coextensive with, said stationary member about an axis of rotation which passes centrally through an enlarged clearance aperture through and common to said stationary and movable members, said clearance aperture sized in transverse width to pass over an enlarged upper grip area of the shaft as said guide is installed onto the shaft, said axis of rotation being aligned with a longitudinal axis of the shaft;

a wind vane connected to and generally orthogonally extending from one end portion of said movable member whereby said movable member is responsive to movement of air to visually align itself in a direction that the golf club is swung;

visual misalignment between the intended line of flight and the direction of golf club swing being visually viewable during each golf swing.

6. A golf club swing guide as set forth in claim 5, wherein:

said stationary and movable members are releasably locked together in a particular alignment relation about the axis of rotation during a golf club swing at the moment of impact between the striking face and a golf ball whereby any misalignment between the stationary and members is preserved for view and analysis after the golf been swung.

* * * * *